US010351380B2

(12) United States Patent
Allen, Jr. et al.

(10) Patent No.: US 10,351,380 B2
(45) Date of Patent: Jul. 16, 2019

(54) DIVERTER CONVEYOR

(71) Applicant: A. G. Stacker Inc., Weyers Cave, VA (US)

(72) Inventors: Clarence C. Allen, Jr., Mt. Crawford, VA (US); Eric Stempihar, Bridgewater, VA (US); Dalton Hege, Weyers Cave, VA (US); Kevin G. Gorby, Harrisonburg, VA (US); Micah C. Sundstrom, Staunton, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 0 days.

(21) Appl. No.: 15/783,630

(22) Filed: Oct. 13, 2017

(65) Prior Publication Data

US 2018/0105383 A1 Apr. 19, 2018

Related U.S. Application Data

(60) Provisional application No. 62/519,406, filed on Jun. 14, 2017, provisional application No. 62/408,633, filed on Oct. 14, 2016.

(51) Int. Cl.
*B65H 29/58* (2006.01)
*B65H 29/62* (2006.01)
(Continued)

(52) U.S. Cl.
CPC ..... *B65H 29/58* (2013.01); *B65H 29/18* (2013.01); *B65H 29/50* (2013.01); *B65H 29/585* (2013.01); *B65H 29/62* (2013.01); *B65H 43/04* (2013.01); *B65H 2301/4473* (2013.01); *B65H 2301/4474* (2013.01); *B65H 2402/10* (2013.01); *B65H 2404/1532* (2013.01); *B65H 2404/261* (2013.01); *B65H 2404/612* (2013.01); *B65H 2404/63* (2013.01); *B65H 2404/693* (2013.01);
(Continued)

(58) Field of Classification Search
CPC ..... B65H 29/58; B65H 2404/63; B65H 2404/631; B65H 2404/632; B65H 2404/633; B65H 2404/62
USPC ..... 271/225
See application file for complete search history.

(56) References Cited

U.S. PATENT DOCUMENTS 3,754,647 A 8/1973 DiFrank et al.
3,904,019 A * 9/1975 Carlen ..... B65H 29/58 198/370.1
(Continued)

*Primary Examiner* — Jeremy R Severson
(74) *Attorney, Agent, or Firm* — J-Tek Law PLLC; Jeffrey D. Tekanic; Scott T. Wakeman

(57) ABSTRACT

A diverter conveyor includes a frame supporting an upper conveyor that has an upstream end and a downstream end and that is configured to carry sheets in a first, downstream, direction. A plurality of nip rollers are mounted on the frame upstream of the upstream end of the upper conveyor and are spaced from the upstream end of the upper conveyor by a gap. The nip rollers feed the sheets along a main path to the upstream end of the upper conveyor. A rejection conveyor is supported by the frame and has a portion beneath the gap and extends away from the upper conveyor at an acute angle. A plurality of paddles are mounted at the first gap, and an actuator is operably connected to the paddles and configured to shift the paddles from a first position out of the main path to a second position in the main path.

21 Claims, 6 Drawing Sheets

(51) Int. Cl.
*B65H 43/04* (2006.01)
*B65H 29/18* (2006.01)
*B65H 29/50* (2006.01)

(52) U.S. Cl.
CPC .... *B65H 2511/16* (2013.01); *B65H 2511/242* (2013.01); *B65H 2511/30* (2013.01); *B65H 2515/84* (2013.01); *B65H 2701/1762* (2013.01); *B65H 2801/42* (2013.01)

(56) References Cited

U.S. PATENT DOCUMENTS 4,004,694 A 1/1977 Sjogren
4,015,840 A 4/1977 Schroder
4,201,102 A * 5/1980 Rudszinat ..... B26D 5/20 83/298
4,265,445 A 5/1981 Langner
4,447,052 A * 5/1984 Muller ..... B65H 29/60 271/227
4,548,404 A * 10/1985 Brandt ..... B65H 29/68 198/462.2
5,211,387 A * 5/1993 Lloyd ..... B65G 43/08 271/10.03
5,445,368 A * 8/1995 Lester ..... B65H 29/145 270/59
8,069,968 B2 * 12/2011 Zimmermann ..... B65H 29/58 198/369.2
8,196,926 B2 * 6/2012 St. Ours ..... B65H 29/58 271/301
8,485,520 B2 * 7/2013 Nakano ..... B07C 3/06 271/176
8,690,153 B2 * 4/2014 Ponti ..... B65H 29/125 271/303
9,114,432 B2 * 8/2015 Mori ..... B65H 29/58
2004/0198577 A1 10/2004 Blumle
2011/0018192 A1 * 1/2011 Moore ..... B65H 5/26 271/225

* cited by examiner

DIVERTER CONVEYOR

CROSS-REFERENCE TO RELATED APPLICATIONS

The present application claims the benefit of U.S. provisional patent application No. 62/519,406, filed Jun. 14, 2017, and U.S. provisional patent application No. 62/408,633, filed Oct. 14, 2016. The contents of both these applications are hereby incorporated by reference.

TECHNOLOGICAL FIELD

The present application is directed to a diverter conveyor for conveying a stream of sheets and for selectively diverting one or more sheets from the stream of sheets. It is also directed to a conveyor system that includes such a diverter conveyor.

BACKGROUND

FIGS. 1-3 illustrate a conventional apparatus for stacking sheets, such as sheets of corrugated paperboard. The stacking system 100 generally comprises a layboy section 102 which receives a stream of sheets, such as those produced by a rotary die cut machine 103, and discharges the sheets onto a transfer conveyor 104. The transfer conveyor 104 receives the sheets and transports them to a main conveyor 106. The main conveyor 106 has an intake end 108 and a discharge end 110, and the transfer conveyor has an intake end 112 and a discharge end 114. At the main conveyor intake end 108, the main conveyor 106 is mounted to a base 116 at a pivot point 118 so that the main conveyor 106 may be pivoted to raise its discharge end 110. At the discharge end 110 of main conveyor 106, an accumulator section 120 receives discharged sheets.

In operation, the main conveyor 106 is pivoted about the pivot point 118 to lower the discharge end 110 of the main conveyor 106 to an initial or lowered position, illustrated in FIG. 2. Sheets are fed onto the main conveyor 106 at its intake end 108, transported along the conveyor to its discharge end 110, and discharged from the conveyor toward a backstop 122 in am accumulator section 120. The sheets in the accumulator section 120 settle down, typically onto a discharge conveyor 132, to form a stack of sheets.

SUMMARY

It is sometimes desirable to extract or divert sheets from a stream of sheets moving through a stacking system from a rotary die cut machine to a stacker accumulator. This may be done for various reasons, which include, without limitation: 1) diverting the first "n" sheets after a rotary die cut machine starts operating on the basis that the first several sheets output by the rotary die cut machine may not be cut properly and/or may have excessive scrap attached thereto; 2) manually extracting one or more sheets, in response to an operator pushing a button, for example, during normal operation for examination for quality control purposes; 3) automatically periodically extracting one or more sheets, e.g., one sheet after every given number of sheets has passed a point or one sheet at predetermined time intervals, again for quality control purposes; or 4) extracting a sheet in response to a detected condition or defect in a sheet the stream of sheets upstream from the extraction section. For example, a suitable optical scanner could monitor the shape or alignment of passing sheets and trigger the diverter conveyor to extract or divert any sheets that are determined to be defective and/or to have the detected condition Such sheet extraction is made possible by the present disclosure which includes a diverter conveyor that can be mounted between two conventional conveyor sections of a sheet stacking system, between a layboy and a transfer conveyor, or between a transfer conveyor and a main conveyor, for example. In the alternative, the diverter conveyor may replace a conventional transfer conveyor. In the following description, the diverter conveyor will be described as performing a conventional transfer conveyor function and carrying sheets from the output of a layboy to the input of a stacker.

The diverter conveyor includes a top conveyor path that, during ordinary, non-diverting operation, receives sheets from the output of the layboy and carries those sheets to the input of a stacker. However, when it is desired to extract one or more sheets from the stream of sheets, for the reasons discussed above or other reasons, a set of paddles is actuated to divert the one or more sheets from the stream onto a rejection conveyor. The rejection conveyor may deposit the diverted sheets in a desired location or may deposit the rejected sheets onto a further extraction conveyor to carry the rejected sheets to an operator or to a temporary storage location. Details of the operation of such a system are provided below.

A first aspect of the disclosure comprises a diverter conveyor that includes a frame supporting an upper conveyor, the upper conveyor having an upstream end and a downstream end and being configured to carry sheets of material in a first direction from the upstream end toward the downstream end. The diverter conveyor also includes a plurality of nip rollers mounted on the frame upstream of the upstream end of the upper conveyor, and the plurality of nip rollers are spaced from the upstream end of the upper conveyor by a first gap. The plurality of nip rollers are configured to feed the sheets of material along a main path to the upstream end of the upper conveyor. A rejection conveyor is supported by the frame and has an upstream end and a downstream end and a portion beneath the first gap. The rejection conveyor extends away from the upper conveyor at an acute angle. A plurality of paddles are mounted at the first gap, and an actuator is operably connected to the plurality of paddles and is configured to shift the plurality of paddles from a first position out of the main path to a second position in the main path.

Another aspect of the disclosure comprises a diverter conveyor that includes a frame having a top and a bottom and a first end and a second end, the second end being spaced from the first end in a sheet travel direction. The diverter conveyor also includes an upper conveyor supported by the frame and having a first end and a second end and a top surface lying in a plane. The second end of the upper conveyor is spaced from the first end of the upper conveyor in the sheet travel direction. A rejection conveyor is supported by the frame and has a first end and a second end, the second end of the rejection conveyor being spaced from the first end of the rejection conveyor in the sheet travel direction. The first end of the rejection conveyor is spaced from the frame bottom by a first distance, and the second end of the rejection conveyor is spaced from the frame bottom by a second distance less than the first distance. A plurality of paddles are mounted on a rod supported at the first end of the frame and located upstream of the first end of the upper conveyor, and the plurality of paddles are shiftable from a first position entirely to one side of the plane to a second position extending through the plane. An actuator is operably connected to the plurality of paddles and configured to shift the plurality of paddles from the first position to the second position.

DETAILED DESCRIPTION

Figure 1:
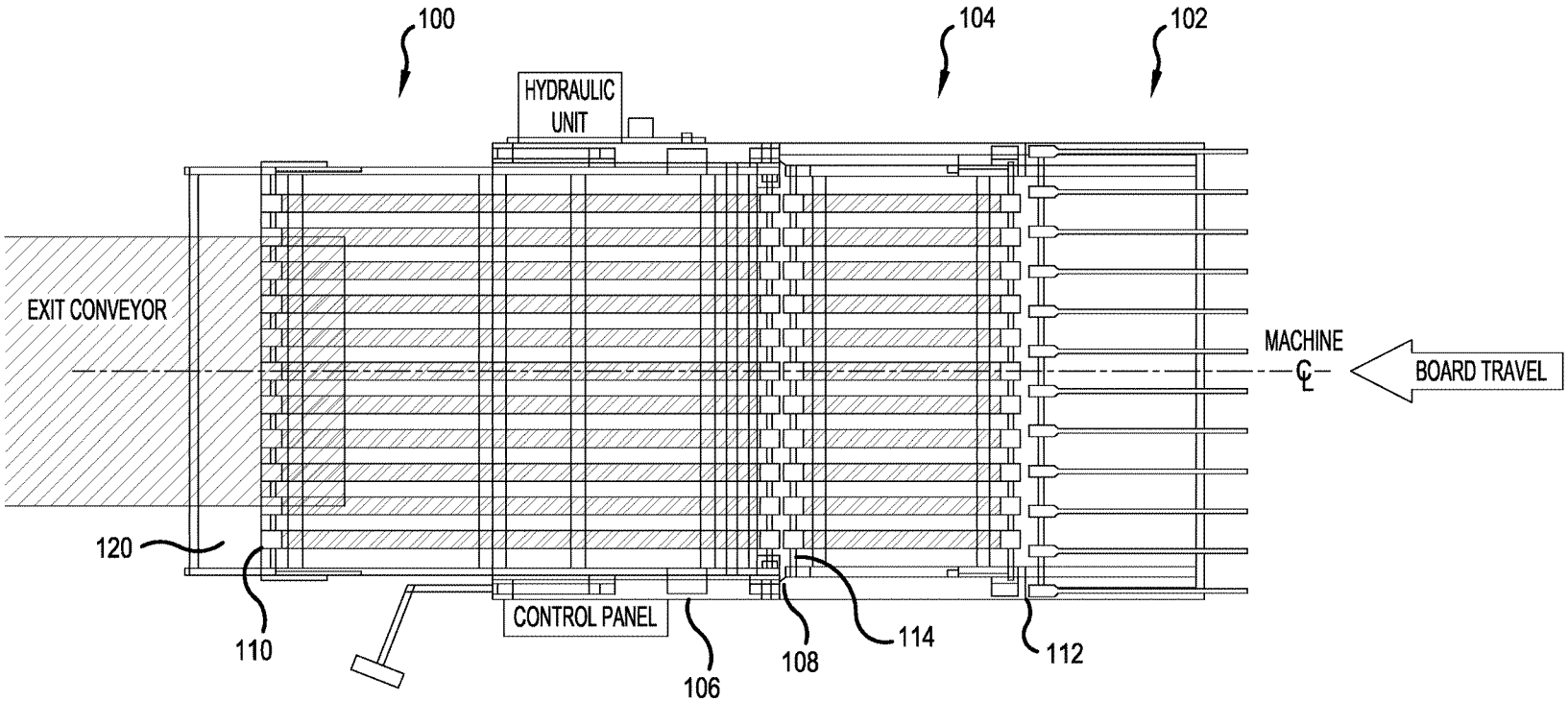
FIG.1 CONVENTIONAL ART
FIG. 1 is top plan view of a conventional stacking system.
Figure 2:
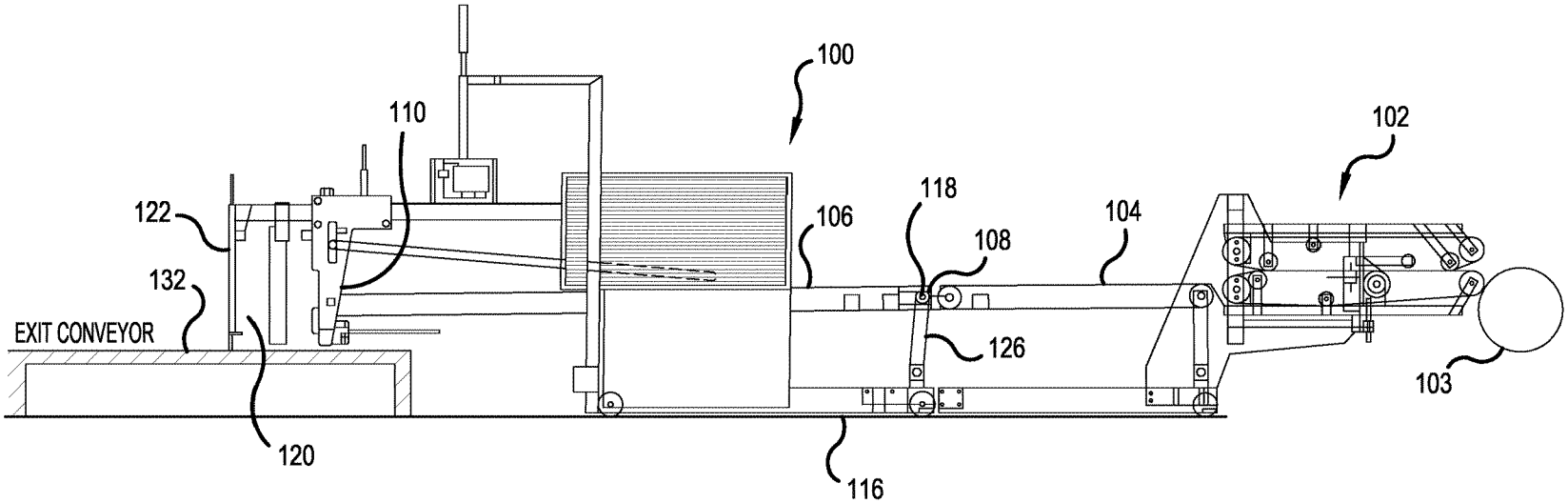
FIG.2 CONVENTIONAL ART
FIG. 2 is a side elevational view of the stacking system of FIG. 1 with the end of the stacker main conveyor in a lowered position.
Figure 3:
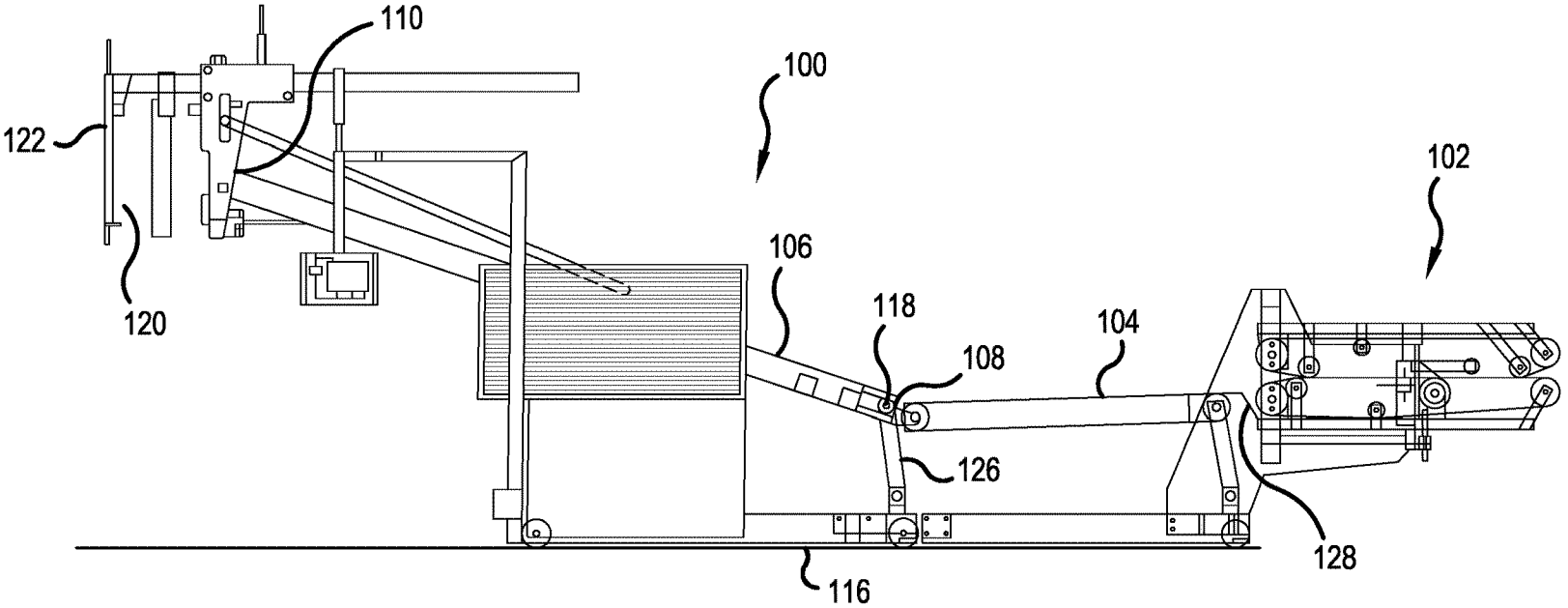
FIG.3 CONVENTIONAL ART
FIG. 3 is a side elevational view of the stacking system of FIG. 2 with the end of the stacker main conveyor in a raised position.
Figure 4:
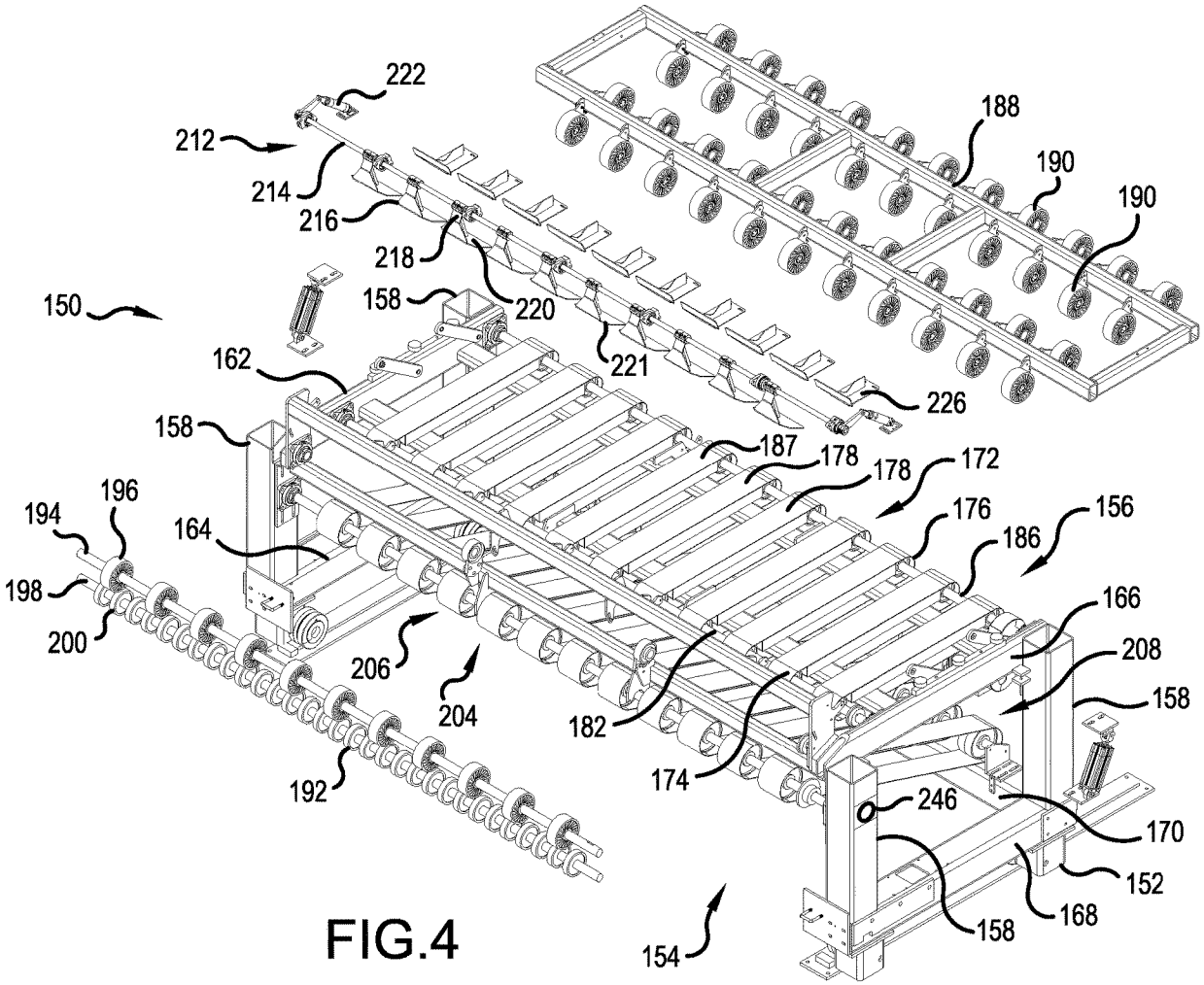
FIG. 4 is an exploded perspective view of a diverter conveyor according to the present disclosure.
Figure 5:
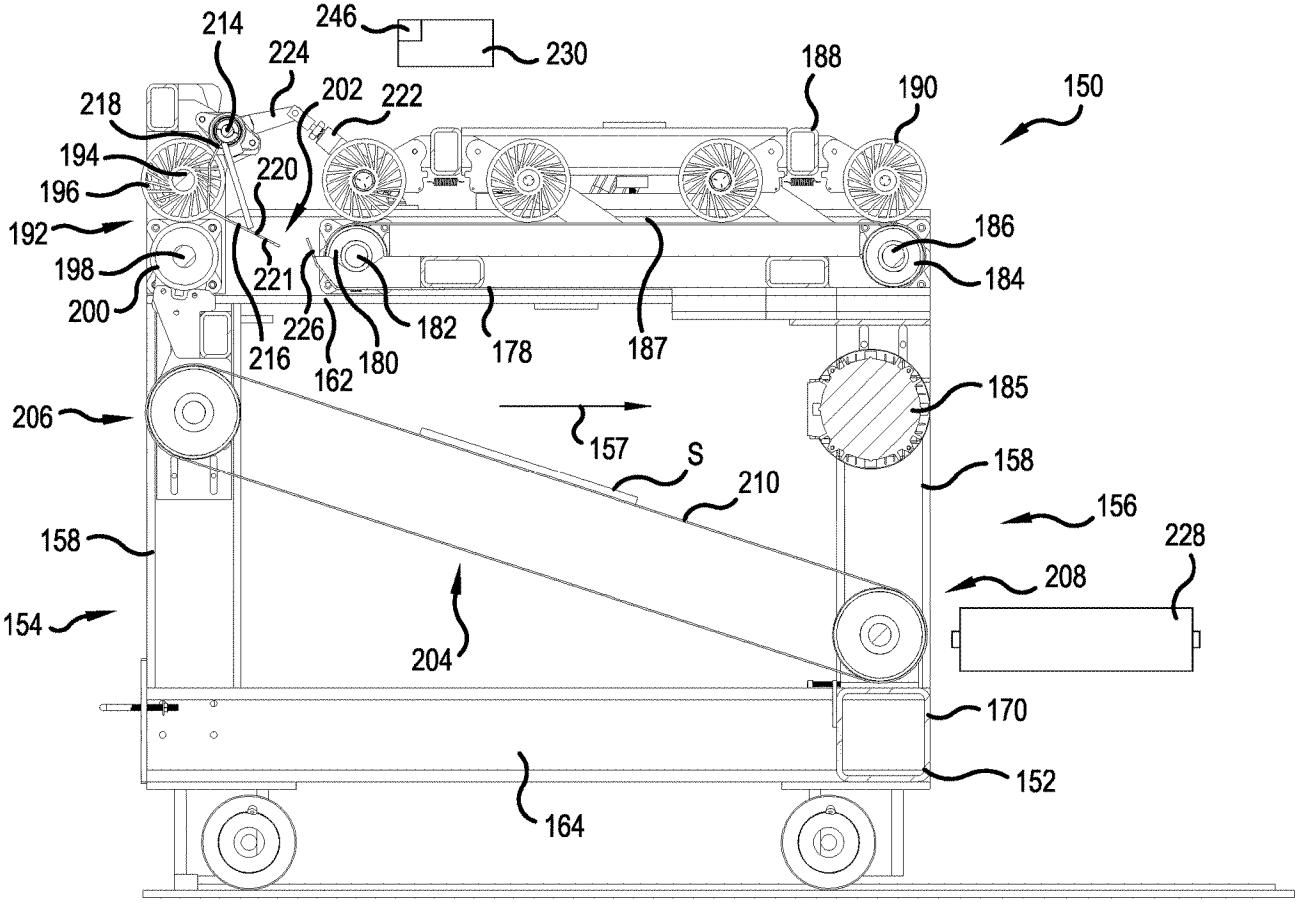
FIG. 5 is a side elevational view of the diverter conveyor according to the present disclosure.

Referring now to the drawings, wherein the showings are for the purpose of illustrating a presently preferred embodiment of the invention only and not for the purpose of limiting same, FIGS. 4 and 5 show a diverter conveyor 150 that includes a frame 152 having a first end 154 and a second end 156, the first end 154 being located upstream from the second end 156. As used herein, the terms "upstream" and "downstream" refer to the intended travel direction of sheets S being carried by the diverter conveyor 150, which direction is from left to right as indicated by arrow 157 in FIG. 5. The sheets will generally be separated in the travel direction by small gaps, and multiple rows of sheets may be carried in parallel from a rotary die cut machine to a stacking machine along the diverter conveyor 150.

The frame 152 includes four vertical supports 158, one at each of the left and right sides of the first end 154 and one at each of the left and right sides of the second end 156. As used herein, "left" and "right" are used relative to the point of view of a person looking in the downstream direction at the first end 154 of the diverter conveyor 150. The frame 152 also includes a left upper horizontal support 162 and a left lower horizontal support 164 connecting the vertical supports 158 on the left side of the diverter conveyor 150 and a right upper horizontal support 166 and a right lower horizontal support 168 connecting the vertical supports 158 on the right side of the diverter conveyor 150. A downstream transverse support 170 connects the vertical supports 158 at the second end 156 of the diverter conveyor 150.

An upper conveyor 172 is supported by the frame 152 and includes an upstream end 174 and a downstream end 176. The upstream end 174 of the upper conveyor 172 is located between the first end 154 and the second end 156 of the frame 152 generally at the level of the left and right upper horizontal supports 162, 166. The downstream end 176 is located at the second end 156 of the frame 152 between the vertical supports 158 at the second end 156 of the frame 152. The upper conveyor 172 comprises a plurality of individual belts 178 that extend between a plurality of upstream pulleys 180 mounted on a first transverse shaft 182 and a plurality of downstream pulleys 184 mounted on a second transverse shaft 186. The belts 178 have top surfaces 187 that lie substantially in a plane. A drive 185 is operatively connected to the first transverse shaft 182 or the second transverse shaft 184 for driving the upper conveyor 172 in a conventional manner.

The upper conveyor 172 also includes a roller frame 188 on which a plurality of rollers 190, which preferably have knurled outer surfaces, are mounted such that the rollers 190 are located at a small distance above the top surfaces 187 of the belts 178 so that the rollers 190 and the top surfaces 187 of the belts 178 define a sheet travel path. The rollers 190 help hold the sheets against the belts 178 as the sheets are carried along the upper conveyor 172 and may sometimes be referred to as a "zero-crush" roller assembly because they are configured to guide the sheets without bending or damaging them. The roller frame 188 is movable relative to the top surfaces 187 of the belts 178 in order to accommodate sheets of different thicknesses and to allow access to the belts 178 in order to remove jammed sheets.

A nip roller assembly 192 is located between the vertical supports 158 at the first end 154 of the frame 152 and includes a first transverse shaft 194 supporting a plurality of upper nip rollers 196 and a second transverse shaft 198 supporting a plurality of lower nip rollers 200. Either the first transverse shaft 194 or the second transverse shaft 198 is driven to pull sheets into the diverter conveyor 150. Opposed pairs of the upper and lower nip rollers 196, 200 define a nip through which sheets arriving at the diverter conveyor 150 must pass on their way to the upper conveyor 172. The nip is located at approximately the same height as the top surfaces 187 of the belts 178 so that an approximately horizontal main travel path is defined from the nip roller assembly 192 to the upper conveyor 172. The upper and lower nip rollers 196, 200 are separated from the upstream end 174 of the upper conveyor 172 by a gap 202.

The diverter assembly 150 also includes a rejection conveyor 204 having an upstream end 206 between the vertical supports 158 at the first end 154 of the frame 152 and generally below the nip roller assembly 192 and a downstream end 208 located between the vertical supports 158 at the second end 156 of the frame 152 generally below the downstream end 176 of the upper conveyor 172. The downstream end 208 of the rejection conveyor 204 is lower than the upstream end 206 of the rejection conveyor 204 so that the rejection conveyor 204 extends at a downward acute angle away from the nip roller assembly 192 in the downstream direction. Like the upper conveyor 172, the rejection conveyor 204 comprises a plurality of belts 210 separated transversely by gaps.

A rejection assembly 212 is located downstream of the nip roller assembly 192 at the gap 202. The rejection assembly comprises a rod 214 rotatably supported between the vertical supports 158 at the first end 154 of the frame 152 and a plurality of paddles 216 fixed to the rod 214 such that the paddles 216 rotate with the rod 214. The paddles 216 are distributed along the rod 214 such that at least one paddle 216 and preferably at least two of the paddles 216 will be associated with each stream of sheets moving through the diverter conveyor 150. Each of the paddles 216 includes a first portion 218 that connects to the rod 214 and a second portion 220 extending from the first portion 218 at an obtuse angle which second portion 218 includes a smooth, flat outer surface 221 configured to make contact with the sheets when it is desired to divert one or more sheets from the stream of sheets.

The rod 214 is pivotable between a first position (not illustrated) and a second position (illustrated in FIG. 5) by an actuator 222, such as a pneumatic actuator, which extends and retracts to push and pull an arm 224 extending from the rod 214 and thus rotate the rod 214. When the rod 214 is in the first position, the paddles 216 are located entirely to one side of the plane of the upper surfaces 187 of the upper conveyor belts 178, and in this position, do not interfere with the movement of sheets from the nip roller assembly 192 to the upper conveyor 172. When the rod 214 is in the second position, the paddles 216 are pivoted downwardly into the path taken by the sheets from the nip roller assembly 192 to the upper conveyor 172 and thus deflect the sheets from their main travel path and prevent the sheets from reaching the upper conveyor 172.

A plurality of diverter plates 226 are located below the upstream end 174 of the upper conveyor 172 at a level below the main travel path of the sheets. Sheets diverted by the paddles 216 when the rod 214 is in the second position travel toward and impact against the diverter plates 226 which further diverts the sheets toward the upper surface of the rejection conveyor 204.

An optional exit conveyor 228 (FIG. 5) is located at the downstream end 208 of the rejection conveyor 204. The exit conveyor 228 runs at approximately a right angle to the rejection conveyor 204 and carries sheets that have been diverted from the stream of sheets from under the diverter conveyor 150 to a location more readily accessible to an operator.

A controller 230 controls the operation of the stacking system 100, and may comprise a programmable logic controller (PLC). The controller 230 is configured to, among other operations, control the actuator 222 and shift the rod 214 between the first and second positions described above. When the rod 214 is in the first position, the sheets travel from the nip roller assembly 192 to the upstream end 174 of the upper conveyor 172 and to the stacker 108. However, when the controller 230 sends a signal to the actuator 222 to shift the rod 214 to the second position, the second portions 220 of the paddles 216 are pressed into the moving stream of sheets in the gap 202 between the nip rollers 196, 200 and the upper conveyor 172, and sheets exiting the nip roller assembly 192 impact against the lower surfaces of the paddles 216 and are diverted in a downward direction toward the rejection conveyor 204, first, optionally, impacting against the diverter plates 226 which also help guide the moving sheets toward the rejection conveyor 204. The actuator 222 holds the rod 214 in the second position long enough to divert one (or any desired number) of sheets away from the upper conveyor 172 and onto the rejection conveyor 204 and then returns the rod 214 to the first position out of the stream of sheets until it becomes necessary or desirable to divert additional sheets to the rejection conveyor 204.

Figure 6:
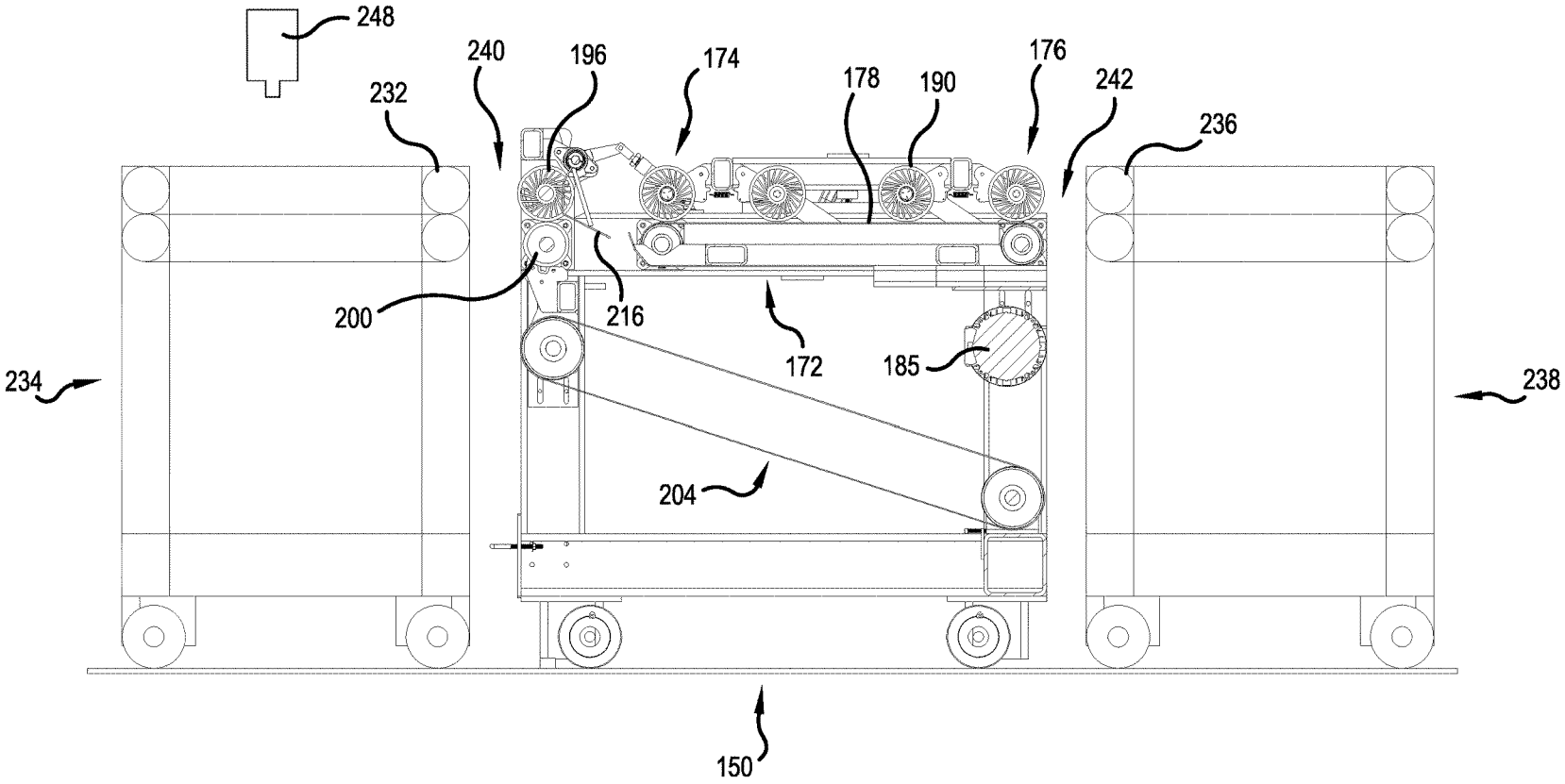
FIG. 6 is a side elevational view of a conveyor system that includes the diverter conveyor of FIG. 5 located between two additional conveyors.

The operation of the diverter assembly 150 at a location between the downstream end 232 of a feeding conveyor 234 (which may be a layboy) and the upstream end 236 of a receiving conveyor 238 (which may be the conveyor of a conventional stacker) is described below with reference to FIG. 6.

In a steady state operation, when the rotary die cut machine 103 is operating normally, one or more streams of sheets exits the rotary die cut machine 103 and is carried by the feeding conveyor 234 to the downstream end 232 of the feeding conveyor 234. A gap 240 exists between the downstream end 232 of the feeding conveyor 234 and the nip roller assembly 192, and the traveling sheets cross this gap 240 and are pulled downstream by the rotating upper and lower nip rollers 196, 200. The sheets are guided by the nip rollers 196, 200 along the main travel path until the leading edges of the sheets reach the upstream end 174 of the upper conveyor 172. From there, the sheets travel across the upper conveyor 172 between the belts 178 and the rollers 190 and are discharged from the downstream end 176 of the upper conveyor 172 across a gap 242 to the upstream end 236 of the receiving conveyor 238.

When the controller 230 receives a signal, the controller 230 causes the actuator 222 to shift the rod 214 from the first position, in which the paddles 216 are located outside the main travel path of the sheets, to the second position, in which the paddles 216 extend into the main travel path of the sheets. With the rod 214 in this second position, sheets exiting the nip roller assembly 192 impact the paddles 216 and are directed against the diverter plates 226 and onto the rejection conveyor 204. The rejected sheets then travel to the exit conveyor 228 and are deposited at a location from which they can be retrieved by an operator. The signal may be generated for a brief period, long enough to remove one sheet from the stream, or may be maintained for a longer period, at system startup for example, to remove a continuous series of sheets from the stream (on the assumption, for example, that the first few sheets produced by a rotary die cut machine at start up may not be properly aligned and/or may have other imperfections).

The signal may be produced in response to various conditions. For example, an operator may generate the signal any time it is desired to remove one or more sheets from the stream by pressing a button 246 which may be a physical button on the diverter conveyor 150 as schematically illustrated in FIG. 4, or a virtual button associated with the controller 230 as illustrated in FIG. 5. Alternately or in addition, a sensor 248 may be provided for generating the signal in response to a sensed condition. The sensed condition may be, for example, that a predetermined number of sheets have passed the sensor. For example, if it is desirable to remove every 1000th sheet from a stream for quality control purposes, the sensor 248 may count sheets and generate a brief signal after counting 999 sheets so that the 1000th sheet will be removed. Alternately, the sensor 248 may generate a signal each time a single sheet passes the sensor and the controller 230 may count the signals and take appropriate action after the 1000th signal is received.

The sensed condition may also be a condition of the sheets. For example, if the sensor 248 is an optical sensor, it may generate the signal in response to detecting a defect, e.g., a printing defect or cutting defect, in the stream of sheets and generate the signal to cause the defective sheets to be removed from the stream.

A person of ordinary skill in the art will understand that the delay between the signal being received at the controller 230 and the controller causing the actuator 222 to shift the rod 214 to the second position will be based on the length and speed of the sheets. For example, if the sheets are traveling at one foot per second and the sensor is located three feet from the rejection assembly 212, the controller will wait approximately three seconds after receiving the signal before causing the actuator 222 to shift the rod 214 to the second position so that the paddles cause the detected sheet to be diverted.

The controller 230 will cause the actuator 222 to hold the rod 214 in the second position for an amount of time based on the travel speed of the sheets, the time being selected to be long enough that the leading edge of the sheet being diverted passes the diverter plates 226 and will not spring back toward the upper conveyor 172 when the rod 214 returns to the first position. The diverted sheet will thereafter be carried along the rejection conveyor 204 to the downstream end 208 of the rejection conveyor 204 from where it passes onto the exit conveyor 228 and is carried to an operator.

The present invention has been described herein in terms of a presently preferred embodiment. Modifications and additions to this embodiment will become apparent to persons of ordinary skill in the art upon a reading of this description. All modifications and additions are intended to form a part of the present invention to the extent they fall within the scope of the several claims appended hereto.

We claim:

1. A diverter conveyor comprising:

a frame supporting an upper conveyor, the upper conveyor having an upstream end and a downstream end and being configured to carry sheets of material in a first direction from the upstream end toward the downstream end, a plurality of nip rollers mounted on the frame upstream of the upstream end of the upper conveyor, the plurality of nip rollers being spaced from the upstream end of the upper conveyor by a first gap, the plurality of nip rollers being configured to feed the sheets of material along a main path to the upstream end of the upper conveyor without cutting the sheets of material;

a rejection conveyor supported by the frame and having an upstream end and a downstream end and a portion beneath the first gap, the rejection conveyor extending away from the upper conveyor at an acute angle;

a plurality of paddles mounted at the first gap; and an actuator operably connected to the plurality of paddles and configured to shift the plurality of paddles from a first position spaced from the main path to a second position in the main path.

2. The diverter conveyor according to claim 1, wherein the plurality of paddles are configured such that when the plurality of paddles are in the first position, sheets exiting the nip rollers travel along the main path to the upstream conveyor and such that when the plurality of paddles are in the second position, sheets exiting the nip rollers are diverted away from the main path by the paddles along a diverted path and onto the rejection conveyor.

3. The diverter conveyor according to claim 2, wherein the plurality of paddles are mounted on a first rod, wherein the first rod is rotatably supported by the frame, and wherein the actuator is configured to rotate the first rod to shift the plurality of paddles from the first position to the second position.

4. The diverter conveyor according to claim 3, including at least one diverter plate at the upstream end of the upper conveyor downstream of the plurality of paddles and below the main path, the at least one diverter plate defining a portion of the diverted path and being configured to divert the sheets toward the rejection conveyor.

5. The diverter conveyor according to claim 4, further including a controller configured to control the actuator.

6. The diverter conveyor according to claim 4, wherein the upper conveyor comprises a plurality of belts extending in the first direction, the belts being spaced in a second direction transverse to the first direction, and a plurality of rollers mounted over the plurality of belts for defining an upper conveyor travel path between the plurality of rollers and the plurality of belts for carrying the sheets in the first direction.

7. The diverter conveyor according to claim 6, wherein the frame comprises a first upstream vertical support and a second upstream vertical support spaced from the first upstream vertical support in the second direction and a first downstream vertical support and a second downstream vertical support spaced from the first downstream vertical support in the second direction, wherein the first rod extends from the first upstream vertical support to the second upstream vertical support, and wherein the upstream end of the rejection conveyor is supported by a second rod extending from the first upstream vertical support to the second upstream vertical support.

8. The diverter conveyor according to claim 1, wherein the frame comprises a first upstream vertical support and a second upstream vertical support spaced from the first upstream vertical support in a second direction perpendicular to the first direction and a first downstream vertical support and a second downstream vertical support spaced from the first downstream vertical support in the second direction, wherein the plurality of paddles are mounted on a first rod extending from the first upstream vertical support to the second upstream vertical support, and wherein the upstream end of the rejection conveyor is supported by a second rod extending from the first upstream vertical support to the second upstream vertical support.

9. A conveyor system comprising:

the diverter conveyor according to claim 1;

a feeding conveyor having an upstream end and having a downstream end spaced from the plurality of nip rollers of the diverter conveyor and being configured to feed the sheets of material across a second gap between the downstream end of the feeding conveyor and the plurality of nip rollers to the plurality of nip rollers; and a receiving conveyor having an upstream end located at the downstream end of the diverter conveyor and having a downstream end, the upstream end of the receiving conveyor being spaced from the downstream end of the diverter conveyor by a third gap, the receiving conveyor being configured to receive the sheets from the downstream end of the diverter conveyor.

10. The diverter conveyor according to claim 1, including a sensor configured to detect a condition of the sheets and to produce at least one output signal in response to the detection of the condition, and a controller configured to receive the at least one signal and to control the actuator based on the received at least one signal.

11. The diverter conveyor according to claim 10, wherein the condition of the sheets comprises a number of the sheets passing the sensor.

12. The diverter conveyor according to claim 10, wherein the condition of the sheets comprises a shape or an alignment of the sheets.

13. The diverter conveyor according to claim 10, wherein the condition of the sheets comprises an appearance of the sheets.

14. The diverter conveyor according to claim 1, wherein the plurality of nip rollers are configured to pull sheets of material into the diverter conveyor, and when the plurality of paddles is in the first position, to feed the sheets of material toward the upstream end of the upper conveyor, and when the plurality of paddles is in the second position, to drive the sheets against the plurality of paddles and toward the rejection conveyor.

15. The diverter conveyor according to claim 1, wherein the upper conveyor has a top surface lying in a plane and wherein the plurality of paddles in the first position lie entirely to a first side of the plane and are spaced from the main path.

16. The diverter conveyor according to claim 15, wherein each of the plurality of paddles has a sheet contact surface facing the bottom of the frame, the sheet contact surfaces being located above the plane when the plurality of paddles is in the first position.

17. A diverter conveyor comprising:

a frame having a top and a bottom and a first end and a second end, the second end being spaced from the first end in a sheet travel direction;

an upper conveyor supported by the frame and having a first end and a second end and a top surface lying in a plane, the second end of the upper conveyor being spaced from the first end of the upper conveyor in the sheet travel direction, the upper conveyor being configured to receive sheets of material traveling along a sheet transport path;

a rejection conveyor supported by the frame and having a first end and a second end, the second end of the rejection conveyor being spaced from the first end of the rejection conveyor in the sheet travel direction, the first end of the rejection conveyor being spaced from the frame bottom by a first distance and the second end of the rejection conveyor being spaced from the frame bottom by a second distance less than the first distance, a plurality of paddles mounted on a rod supported at the first end of the frame and located upstream of the first end of the upper conveyor, the plurality of paddles being shiftable from a first position entirely to one side of the plane and spaced from the sheet transport path to a second position extending through the plane, and an actuator operably connected to the plurality of paddles and configured to shift the plurality of paddles from the first position to the second position.

18. The diverter conveyor according to claim 17, including a nip assembly configured to feed the sheets along the sheet transport path past the plurality of paddles to the first end of the upper conveyor.

19. The diverter conveyor according to claim 18, wherein the nip assembly comprises a shaft mounted on the first end of the frame and a plurality of nip rollers supported by the shaft.

20. The diverter conveyor according to claim 19, including at least one diverter plate at the upstream end of the upper conveyor below the plane and above the rejection conveyor, the at least one diverter plate being configured to divert the sheets toward the rejection conveyor.

21. The diverter conveyor according to claim 20, further including a controller configured to control the actuator.

* * * * *